US008109738B2

(12) United States Patent
Vogt

(10) Patent No.: US 8,109,738 B2
(45) Date of Patent: Feb. 7, 2012

(54) VAPOR RECOVERY GAS PRESSURE BOOSTERS AND METHODS AND SYSTEMS FOR USING SAME

(75) Inventor: Robert A. Vogt, Elmhurst, IL (US)

(73) Assignee: Midwest Pressure Systems, Inc., Bensenville, IL (US)

( * ) Notice: Subject to any disclaimer, the term of this patent is extended or adjusted under 35 U.S.C. 154(b) by 715 days.

(21) Appl. No.: 12/338,916

(22) Filed: Dec. 18, 2008

(65) Prior Publication Data

US 2010/0158717 A1 Jun. 24, 2010

(51) Int. Cl.
*F04B 17/00* (2006.01)
*F04B 35/00* (2006.01)

(52) U.S. Cl. ..... 417/401; 417/399

(58) Field of Classification Search ..... 417/46, 417/225, 226, 399, 401; 166/267; 175/217, 175/218
See application file for complete search history.

(56) References Cited

U.S. PATENT DOCUMENTS 5,564,912 A * 10/1996 Peck et al. ..... 417/396
6,453,843 B2 * 9/2002 Bescherer ..... 119/51.01

OTHER PUBLICATIONS

Haskel Brochure titled "Compressed Natural Gas Pressure Amplifier Systems for CNG Refueling Stations of Gas Utility Fleet Vehicles", 1989.

The Feasibility and Application of Using Pressure Amplifier Systems to Refuel Natural Gas Vehicles in Saskatchewan; by Chris M. Biegler; Apr. 1996.

"Analysis of a Pressure Amplifier System for School Bus Fleets in Saskatchewan"; prepared by Tara Isabelle, BA; Dec. 31, 1996.

Midwest Pressure Systems; Manufacturer of Air and Gas Pressure Booster Systems; 2.1 Ratio Gas Pressure Boosters; http://www.midwestpressuresystems.com/Gas%20Press%20Boosters1.html, Jan. 1, 2008.

Midwest Pressure Systems; Pressure Booster Technical Manual, Feb. 1, 2005.

* cited by examiner

*Primary Examiner* — Nimeshkumar Patel
*Assistant Examiner* — Glenn Zimmerman
(74) *Attorney, Agent, or Firm* — Michael P. Mazza, LLC

(57) ABSTRACT

A gas pressure booster and a method for using it, which recovers fugitive gas emissions such as at atmospheric pressure, boosts them such as to the pressure level of the low pressure gas sink, and returns them to, e.g., the low pressure gas sink, in a single stage of compression. No electricity or cooling water is required. All gas used to drive the vapor recovery booster may be recovered and vented to the low pressure gas sink.

In one preferred embodiment, the gas pressure booster includes a drive cylinder and a boost cylinder interconnected by reciprocating drive and boost pistons. The drive piston supplies force powered by a first gas stream within the drive cylinder which exhausts to a second gas stream at a lower pressure. Fugitive gas emissions may be captured and transported to the lower pressure second gas stream to eliminate gas discharged to atmosphere. The need for boosting a gas multiple ratios is eliminated, as the pressure of the fugitive emission vapor is equalized to the low pressure gas sink at the end of the piston suction stroke. Preferably, a four-way valve operating on differential gas pressure may be used to automatically actuate the reciprocating piston.

21 Claims, 3 Drawing Sheets

VAPOR RECOVERY GAS PRESSURE BOOSTERS AND METHODS AND SYSTEMS FOR USING SAME

BACKGROUND OF THE INVENTION

The present invention relates to gas pressure boosters. More specifically, the present relates to gas pressure boosters and methods and systems for using them in which fugitive emissions are captured, and in which the need for staged gas compression is largely eliminated.

Gas pressure boosters may include a drive system which provides the energy required to operate a compression system, and a compression system which elevates the gas pressure. The drive systems may include: a crankcase driven by an electric motor or an engine; a turbine drive; a hydraulic piston driven by an electric motor or an engine; and a pneumatic piston driven by air or gas pressure.

The compression system may include:

- a reciprocating piston (providing moderate boost ratios and flowrates, suitability for high operating pressures, low to moderate cost, a compact design, rod seal leakage and vibration, and a moderate operating life for the seals, especially non-lubricated seals);
- a turbine (providing high flowrates, low vibration, a long operating life, suitability for high pressures, low boost ratios, high cost, shaft seal leakage, and a large size);
- a diaphragm (providing high compression ratios, no seal leakage, suitability for high pressures, very low flow, high cost, vibration, and a low operating life);
- a bellows (providing no seal leakage, moderate cost, low flow, low boost ratios, vibration, and a lack of suitability for high pressures);
- a rotary vane (providing high flowrates, low cost, low boost ratios, a lack of suitability for high pressures, and a low operating life);
- a fan (providing high flowrates, low cost, very low boost ratios, and a lack of suitability for high pressures);
- a "roots type" blower (providing high flowrates, moderate cost, long life, low boost ratios, shaft leakage, and a lack of suitability for high pressures); and
- a rotary screw (providing high flowrates, moderate cost, long life, moderate boost ratios, shaft leakage, and a lack of suitability for high pressures).

With moderate to high pressure applications, which are the focus of the preferred embodiment described below, the most practical boost system utilizes a reciprocating piston. Existing piston gas boosters utilize pneumatic or gas drives, crankcase drives and hydraulic drives. For many applications, such as natural gas compression for pipelines, refueling natural gas vehicles and vapor recovery from gas wells, compressed air is either not available or available in sufficient quantity to drive the compression section. Electricity may also not be present, either at all or in sufficient quantities to operate a crankcase or hydraulic drive. There is also frequently a lack of space to locate crankcase-driven machines and engine drives. Accordingly, a compact gas-driven booster may be a good engineering fit in such applications which have high pressure gas (instead of compressed air) available to drive the booster.

Pneumatically-driven gas pressure boosters, also called gas boosters, booster compressors and air amplifiers, that utilize compressed air (or other compressed gases) as the motive force to boost gas pressure, are known. They may be used to boost shop air pressure, to boost nitrogen pressure, for boosting gas pressure to feed dry gas mechanical seals on turbo compressors (to protect the seals), etc. Gas pressure boosters have various advantages: the pressure boost in such devices can be as low as 5 psi or as high as thousands of psi; they require no electricity, cooling water or lubrication; and they are explosion-proof, compact, easy to install and economical. Such advantages may be important in applications located in remote areas where the electricity may not be available (e.g. oil and gas wells). The gas pressure boost ratio is based on the pressure of the available compressed air (or gas), the area ratio between the drive piston and the boost piston, and the boost gas supply pressure. Pneumatically-driven gas pressure boosters are available, for example, from Midwest Pressure Systems of Bensenville, Ill.

With existing pneumatically-driven gas pressure boosters, the boost section includes a single-acting or double-acting cylinder, and inlet and discharge check valves for each pumping chamber. There are variations in check valve design, piston and rod seals, and materials, but all of the existing systems are similar in engineering design.

The pneumatic drive section of the boosters may have several variations, but all consist of a four-way valve which causes the drive piston to reciprocate automatically.

The differences are in the manner used to actuate the valve:

1. Mechanical actuation causes the four-way valve to shift as a result of the drive piston, mechanically moving the valve element at the end of stroke. The piston typically has a lever or pin which triggers the valve at the end of stroke in each direction.

2. Pneumatic pilot shifting actuates the four-way valve through a small amount of pressurized air or gas which forces a piston attached to the valve to move, causing the valve to shift. There are three versions of this design. A first version uses a four-way valve with a double-pilot design which receives a pilot signal at each end of the valve. With this first version, pilot valves are triggered by the piston at the end of each stroke. Each pilot valve sends a pilot air or gas signal to the four-way valve, causing it to shift. After the four-way valve shifts, the pilot air or gas is vented. The second version uses the same two pilot valves, but one valve sends a pilot signal to the pilot side of a single-pilot, spring-return, four-way valve. The pilot air or gas shifts the four-way valve against the spring and remains trapped in the pilot section until the other pilot valve is tripped, venting the air or gas in the pilot section. With this second version, the spring then shifts the four-way valve back to the original position. The third version is similar to the second version. Pilot air or gas actuates a larger pilot piston on one side of the four-way valve and holds it in place. The piston on the other side of the four-way valve is smaller and is always charged with supply air or gas. When pilot air or gas is vented from the first piston the smaller piston shifts the four-way valve back to its original position.

3. Existing booster designs vent the drive air or gas to atmosphere. The pilot air or gas also vents to atmosphere. The drive force is determined by the pressure of the drive air or gas above atmospheric pressure. The flow capability is a function of this drive force as well as the amount of drive air or gas that is available. Typically, the maximum pressure rating of gas booster drive systems is 10 bar or 150 psi, which encompasses the shop air pressure available in most industrial applications.

Rod seal design and materials, piston seal design and materials, and structural materials vary in the pneumatic drive section, but the various models are similar in engineering design.

There is a need for using gas pressure boosters in applications such as oil and gas wells, natural gas pipeline compressor stations, and turbine compressor applications in oil refineries and chemical plants. In many cases, such as gas wells or remote pipeline compressor stations, no electricity is available (all equipment may be run off of natural gas). Available gas pressures can be substantial (e.g., 200-1000 psi). In a gas well, for example, gas from the well enters a separator to remove oil and water. The gas is filtered and transported to a "sales line," which collects gas and transports it to a natural gas processing facility. Sales line pressure may be in the 100-250 psi range. The wellhead gas at a much higher pressure may be reduced in pressure when it enters the sales line, where substantial energy is lost. The oil separated from the gas is sent to an atmospheric pressure condensate storage tank where gas flashes out of the pressure-reduced stream and continues to bubble out of the oil and water at near-atmospheric pressure (flash gas). This gas is typically vented to atmosphere or burned in a flare. The venting of gas-operated controls at the well also is released to the atmosphere or through the flare. It would be advantageous to develop a system for capturing these fugitive gas emissions from the well and recovering this vented gas and returning it to the sales line. Further, if the energy lost in the reduction of gas pressure were used in the fugitive emission vapor recovery effort, there would be little or no energy cost.

These fugitive emissions of volatile organic compounds are a safety and environmental hazard. In Colorado, environmental standards were put into place in December of 2006 in an effort to reduce volatile organic compound emissions which create ozone and negatively effect air quality. These standards were made more stringent after May of 2008 when condensate tanks emitting more than 20 tons per year of volatile organic compounds are required to reduce emissions by 95% to help reduce the high levels of ozone concentrations in the area and keep Colorado in compliance with national air standards.

Vapor recovery requires boosting the fugitive emissions from near atmospheric pressure to a pressure level where they can be returned to the process. When gas is compressed from a low pressure to a significantly higher pressure, it must typically pass through several stages of compression to remove the heat generated during compression. The additional stages of compression require more equipment and cooling between the stages resulting in additional capital costs and energy consumption. Development of equipment which can reduce the number of stages of compression and utilize the gas pressure potential energy available at the source is very desirable.

DEFINITION OF CLAIM TERMS

The terms used in the claims of the patent as filed are intended to have their broadest meaning consistent with the requirements of law. Where alternative meanings are possible, the broadest meaning is intended. All words used in the claims are intended to be used in the normal, customary usage of grammar and the English language.

"Atmospheric pressure" means 14.7 psia (absolute pressure) or 0 psig (gauge pressure).

"Boost compression ratio" means the ratio of the increased pressure of a gas to the original pressure of that gas.

"Captured and transported" means that substantially all of the fugitive emission gas in question is captured and returned to the gas pressure booster and/or the process.

SUMMARY OF THE INVENTION

The objects mentioned above, as well as other objects, are solved by the present invention, which overcomes disadvantages of prior pressure gas boosters and systems and methods for using them, while providing new advantages not previously associated with such boosters, systems and methods.

In a preferred embodiment of the invention, a gas pressure booster is provided, and includes a drive cylinder and a boost cylinder interconnected by reciprocating drive and boost pistons. Initially, the drive cylinder may be operated with drive gas at a first gas pressure. The drive gas may be vented at a second gas pressure which is lower than the first gas pressure. During a piston stroke the boost cylinder charges through an inlet check valve with fugitive gas emission. In this embodiment, the trapped drive gas in the drive cylinder at the end of a stroke at the first higher gas pressure flows to the charged boost cylinder. Any excess gas flows out of the boost cylinder through a discharge check valve to the second, lower pressure, so that the gas pressures in the boost cylinder and the drive cylinder equalize at a pressure higher than the fugitive emission gas pressure. The resulting, equalized pressure in the boost cylinder eliminates the need to stage gas compression, as might otherwise be required given the boost compression ratio between the fugitive emission gas pressure and the second lower gas pressure. The piston stroke of the boost cylinder may be reversed, discharging the mixture of fugitive gas emissions and pressure-reduced drive gas to a line containing the second lower pressure gas. Fugitive gas emissions from operation of the gas pressure booster, such as gas emissions from seal leaks or pilot valve vents in the gas pressure booster, may be captured and transported to the lower pressure second gas stream to eliminate gas discharged to atmosphere.

In a particularly preferred embodiment, a four-way valve operating on differential gas pressure may be used to actuate the reciprocating pistons. The four-way valve may be actuated in various ways. For example, it may be actuated using gas pilot pressure, or a mechanical actuation, applied on each side of the valve. As another example, the four-way valve may be actuated by pilot pressure applied on one side of the valve; when this pressure is vented, a spring may be used to actuate the other side of the valve. As a further example, the four-way valve may be actuated by pilot pressure applied to a valve piston acting on one side of the valve; when this pilot pressure is vented, supply pressure acting on a smaller valve piston on the other side of the valve may be used to actuate the valve. In each case, return of the valve may be actuated by venting the pilot pressure to a low gas pressure line.

The gas pressure booster may be operated without the need for electricity or cooling water.

In an alternative preferred embodiment of the invention, a method is provided for recovering fugitive gas emissions from a gas pressure booster having a drive cylinder, a boost cylinder, and interconnected, reciprocating drive and boost pistons. Initially, the drive cylinder may be operated with drive gas at a first gas pressure. The drive gas may be vented at a second gas pressure which is lower than the first gas pressure. Now, the boost cylinder charges with fugitive gas emissions recovered from operation of the gas pressure booster, by completing a piston stroke of the boost cylinder. The pressure of the recovered fugitive gas emissions is elevated by shutting off the source of boost cylinder drive gas at the first higher gas pressure, creating trapped drive gas.

Again, in this embodiment as well, trapped drive gas at the first higher gas pressure flows to the charged boost cylinder, so that the gas pressures in the boost cylinder and the drive cylinder equalize at a pressure higher than the fugitive emission gas pressure. Again, the resulting, equalized pressure in the boost cylinder eliminates the need to stage gas compression, as might otherwise be required given the boost compression ratio between the fugitive emission gas pressure and the second lower gas pressure. As with the first embodiment, the piston stroke of the boost cylinder may be reversed, discharging the mixture of fugitive gas emissions and pressure-reduced drive gas to a line containing the second lower pressure gas.

In a particularly preferred embodiment, the gas pressures in the boost cylinder and the drive cylinder may equalize at a pressure that is equal to a sink pressure for the gas pressure booster.

The gas booster cylinder may be operated without the need for electricity or cooling water.

In a further alternative embodiment, useful with either the gas booster system or method for using it, two communicating three-way valves may be provided, with one side of the valves connecting the boost cylinder to a vapor line, and the other side of the valves connecting the boost cylinder to a low pressure gas line. In this embodiment, the need for any check valves or low pressure line connections to the boost cylinder may be eliminated.

Those of ordinary skill in the art will appreciate that the gas pressure booster of the present invention may be advantageously employed to recover fugitive gas emissions without the need for external power or staged gas compression, and that it may be used in a variety of devices and systems, including but not limited to oil or gas wells, natural gas pipeline compressor stations, and industrial gas compressors such as turbine compressors.

BRIEF DESCRIPTION OF THE DRAWINGS

The novel features which are characteristic of the invention are set forth in the appended claims. The invention itself, however, together with further objects and attendant advantages thereof, will be best understood by reference to the following description taken in connection with the accompanying drawings. The drawings illustrate currently preferred embodiments of the present invention. As further explained below, it will be understood that other embodiments, not shown in the drawings, also fall within the spirit and scope of the invention.

Figure 1A:
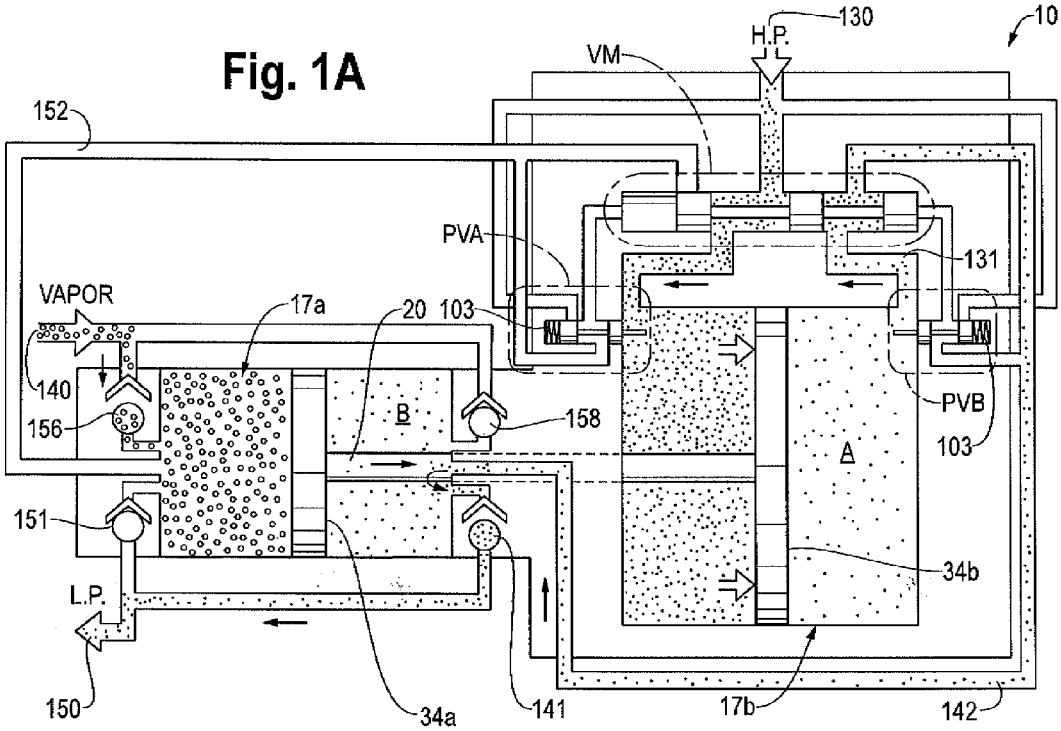
FIGS. 1A-1D are progressive, illustrative schematic views of a gas booster system according to a preferred embodiment of the present invention.

The components in the drawings are not necessarily to scale, emphasis instead being placed upon clearly illustrating the principles of the present invention.

DETAILED DESCRIPTION OF THE PREFERRED EMBODIMENTS

Set forth below is a description of what are currently believed to be the preferred embodiments and/or best examples of the invention claimed. Future and present alternatives and modifications to these preferred embodiments are contemplated. Any alternatives or modifications which make insubstantial changes in function, in purpose, in structure or in result are intended to be covered by the claims of this patent.

Referring now to FIGS. 1A-1D, the operation of a preferred embodiment of the present invention, designated generally as gas pressure booster system 10, will now be described. Referring first to FIG. 1A, gas pressure booster system 10 generally includes boost cylinder 17*a*, drive cylinder 17*b*, and a valving system connecting pilot valves PVA and PVB to a valve manifold/4-way valve designated generally VM, as described below. The valve manifold and all pilot connections are connected to a sink and a source of pressurized gas, as also explained below. A gas vapor source is connected to boost cylinder. The entire system is isolated from the atmosphere surrounding the booster.

As shown in the drawings, drive piston 34*b* in drive cylinder 17*b* is attached to boost piston 34*a* in boost cylinder 17*a* through a common piston rod 20. Boost cylinder 17*a* is double-acting, i.e., it pulls gas in on one side while pumping it out on the other side in both directions of stroke.

Referring first to FIG. 1A, booster system 10 includes boost cylinder 17*a* housing boost piston 34*a*, and drive cylinder 17*b* housing drive piston 34*b*, with each piston sharing a common piston rod 20. A source of high pressure gas is provided at 130, a vapor source is provided at 140, and region 150 is a low pressure gas sink. Piston rod 20 is shown in the middle of a forward piston rod stroke; high pressure gas pushes the front (left) side of drive piston 34*b* in the direction of stroke as shown by the arrow (i.e., to the right). Vapor is sucked into the front (left) side of the boost system through check valve 156. Low pressure gas at the sink pressure (region 150) exits the back side of drive piston 34*b*, passing from region 131 through 4-way valve manifold VM and then through manifold 142 into the front side of boost piston 34*a*. The gas then flows to low pressure sink region 150 through discharge check valve 151.

Figure 1B:
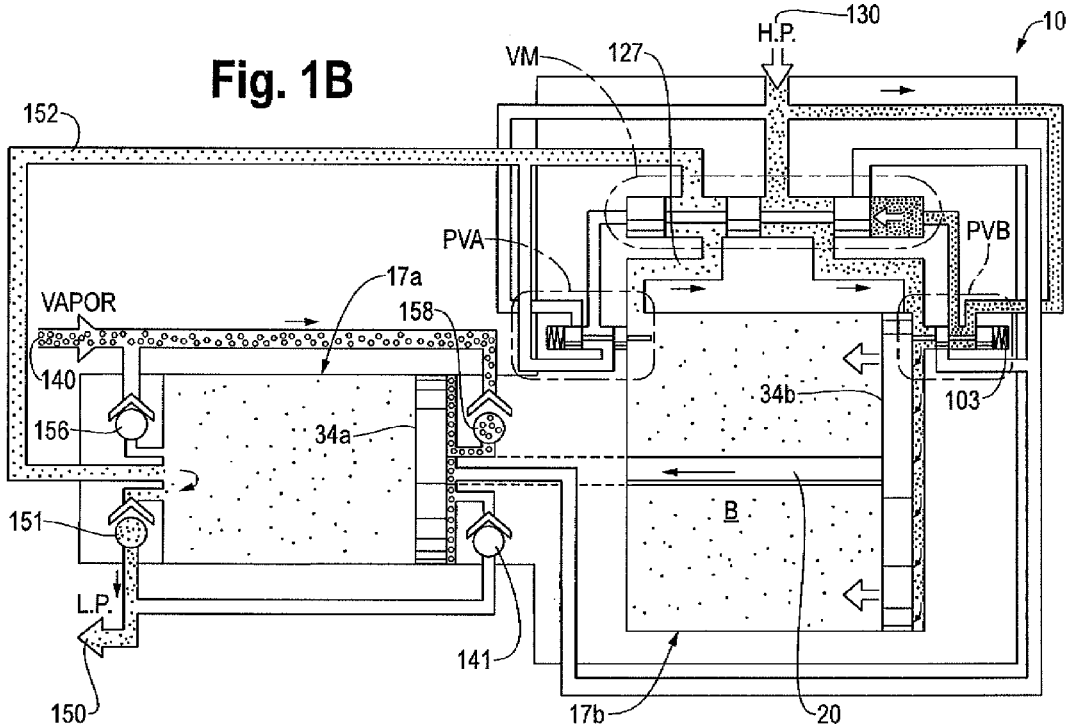

Referring now to FIG. 1B, vapor has filled the front side of boost cylinder 17A and piston 34B has reached the end of its stroke and has opened pilot valve B (PVB). This allows pilot gas to pass through PVB, moving 4-way valve VM to the left, allowing high pressure gas from 130 to enter the back side of drive cylinder 17B and opening a path through manifold 152 for the high pressure gas on the front side of drive cylinder 17B to mix with the recovered vapor and fill the front side of boost cylinder 17A. Manifold 142 is closed. Due to the high pressure gas flow from the front side of drive cylinder 17B, the front side of boost cylinder 17A may reach the low pressure gas sink pressure and excess gas will flow through check valve 151 to the low pressure gas sink 150. High pressure in the front side of boost cylinder 17A causes check valve 156 to close. As piston 34A begins to move to the left, low pressure on the back side of boost cylinder 17A has allowed check valve 158 to open and check valve 141 to close, permitting vapor from region 140 to be sucked into the back side of the boost cylinder through check valve 158, forcing low pressure gas and vapor on the front side of cylinder 17A through check valve 151 and into sink 150.

Figure 1C:
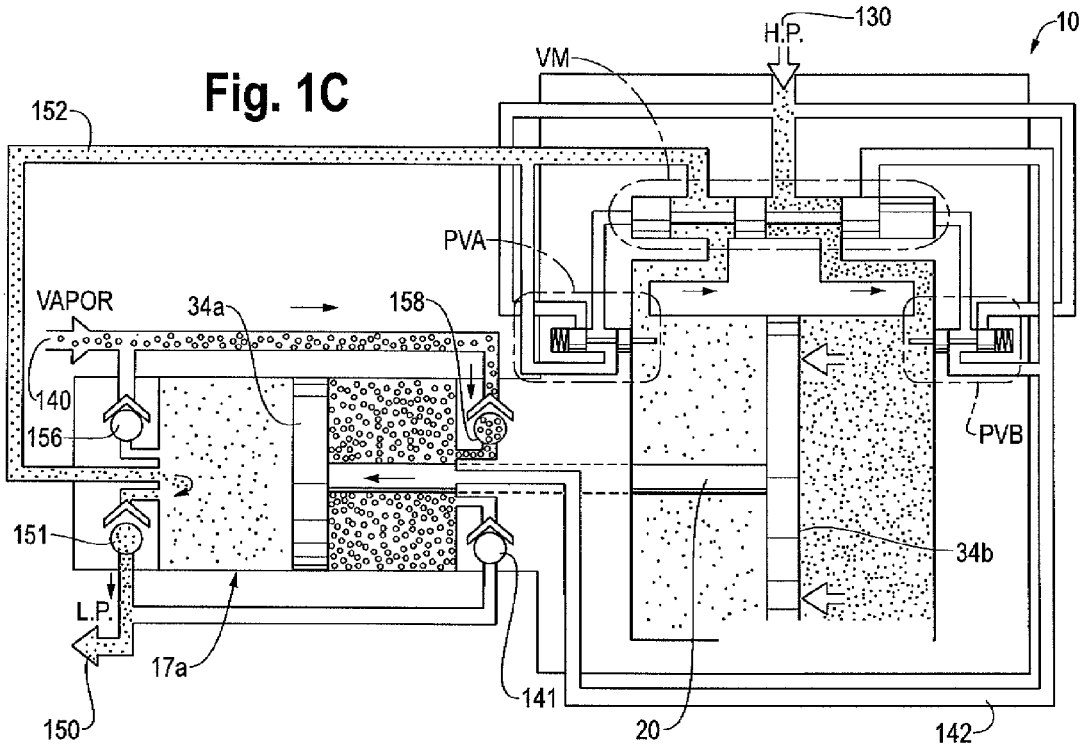

Referring now to FIG. 1C, the drive piston is now halfway through its cycle, still moving to the left, as high pressure gas from source 130 is still filling the back side of the drive cylinder. (VM remains in the same position as in FIG. 1B.) Vapor from region 140 passes through check valve 158 and into the back side of the boost cylinder. Low pressure gas from the front side of the boost cylinder is pushed out of the boost cylinder through manifold 152 into the front side of the boost cylinder and passes through check valve 151 to sink 150.

Figure 1D:
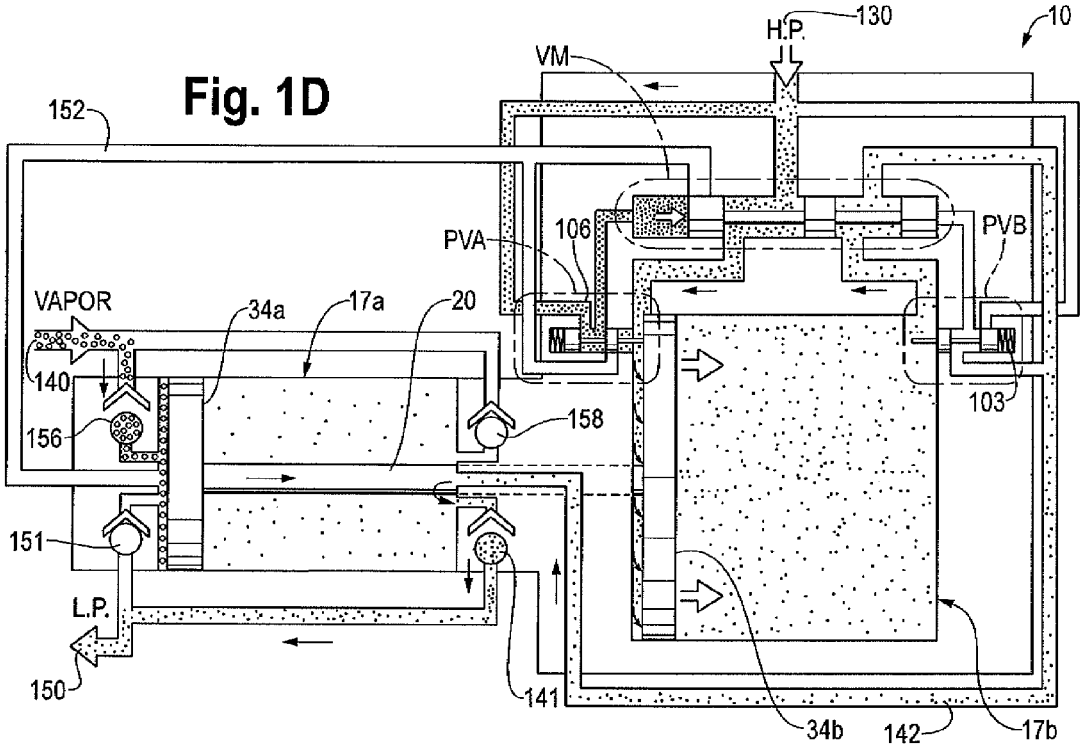

Referring now to FIG. 1D, vapor has filled the back side of boost cylinder 17A and piston 34B has reached the end of its stroke and has opened pilot valve A (PVA). This allows pilot gas to pass through PVA, moving 4-way valve VM to the right, allowing high pressure gas from 130 to enter the front side of drive cylinder 17B and opening a path through manifold 142 for the high pressure gas on the back side of drive cylinder 17B to mix with the recovered vapor and fill the back side of boost cylinder 17A. Manifold 152 is closed. Due to the high pressure gas flow from the back side of drive cylinder 17B, the back side of boost cylinder 17A may reach the low pressure gas sink pressure and excess gas will flow through check valve 141 to the low pressure gas sink 150. High pressure in the back side of boost cylinder 17A causes check valve 158 to close. As piston 34A begins to move to the right, low pressure on the front side of boost cylinder 17A has allowed check valve 156 to open and check valve 151 to close, permitting vapor from region 140 to be sucked into the front side of the boost cylinder through check valve 156, forcing low pressure gas and vapor on the back side of cylinder 17A through check valve 141 and into sink 150.

In the manner described above, the vapor recovery booster will reciprocate automatically and recover fugitive gas emissions at atmospheric pressure, boost them to the pressure level of the low pressure gas sink, and return them to the low pressure gas sink in a single stage of compression. No electricity or cooling water is required. All gas used to drive the vapor recovery booster is recovered and vented to the low pressure gas sink.

Those of ordinary skill in the art will now appreciate that in the preferred embodiment of the gas pressure booster system disclosed here, not only are fugitive emissions eliminated, but the gas pressure booster can run off of the energy supplied by the available high pressure gas source (e.g., gas wellhead pressure or gas compressor discharge), as opposed to having to employ outside/remote energy. All of the booster drive gas emissions and the recovered fugitive emissions are discharged into the low gas pressure sink (e.g., gas sales line or compressor inlet). In addition, the need to boost the vapor pressure to the sink pressure in several stages of compression is eliminated.

It will be understood from the foregoing that the trapped drive gas at the first higher gas pressure flows to the charged boost cylinder, so that the gas pressures in the boost cylinder and the drive cylinder equalize at a pressure higher than the fugitive emission gas pressure. The resulting, equalized pressure in the boost cylinder eliminates the need to stage gas compression, as might otherwise be required given the boost compression ratio between the fugitive emission gas pressure and the second lower gas pressure.

Those of ordinary skill in the art will also appreciate that fugitive gas emissions can be captured using a bag or a tank, or they may be pulled directly from the source, as disclosed above. While the preferred embodiment describes a gas pressure booster and method for using such a system in which all of the fugitive gas emissions are isolated, captured and returned to the booster and/or system, those of ordinary skill in the art will recognize that some desired percentage less than 100% (e.g., 95% of 98%) of such emissions may be captured, if desirable or necessary for some reason, and that the claim term "captured and transported" will cover such "substantially all" emissions.

Figure 2A:
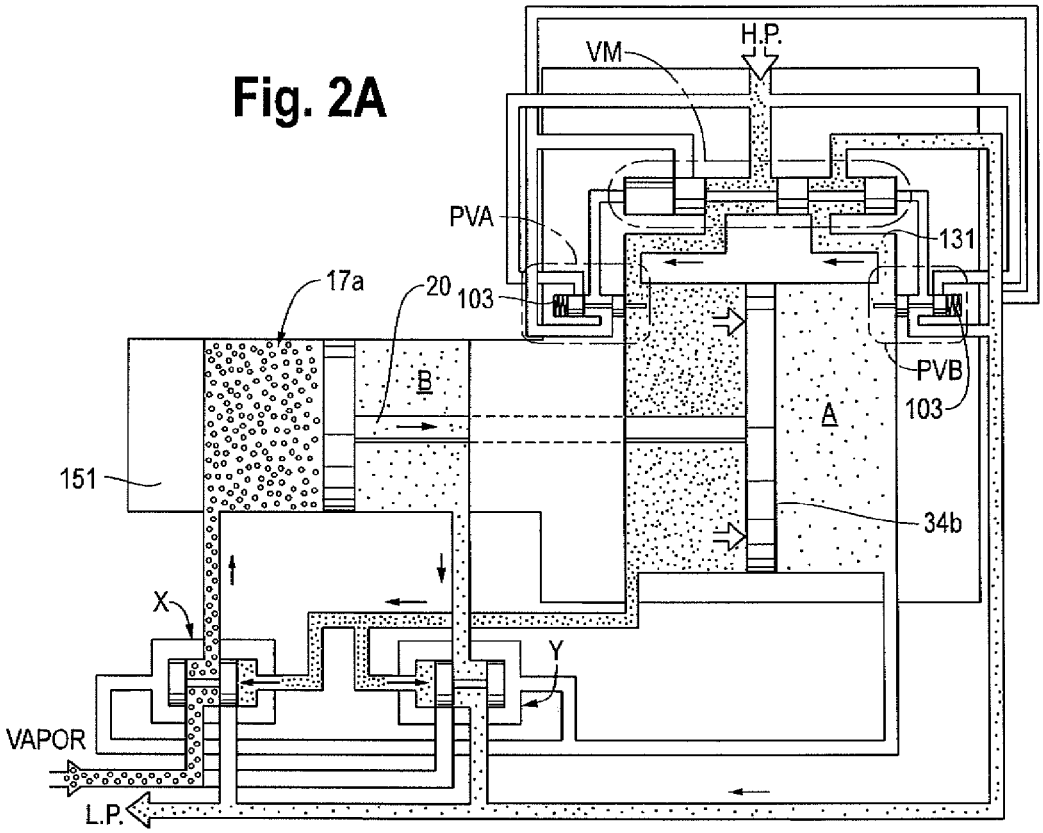
FIGS. 2A-2B are illustrative schematic views of a gas booster system according to an alternative preferred embodiment of the present invention.
Figure 2B:
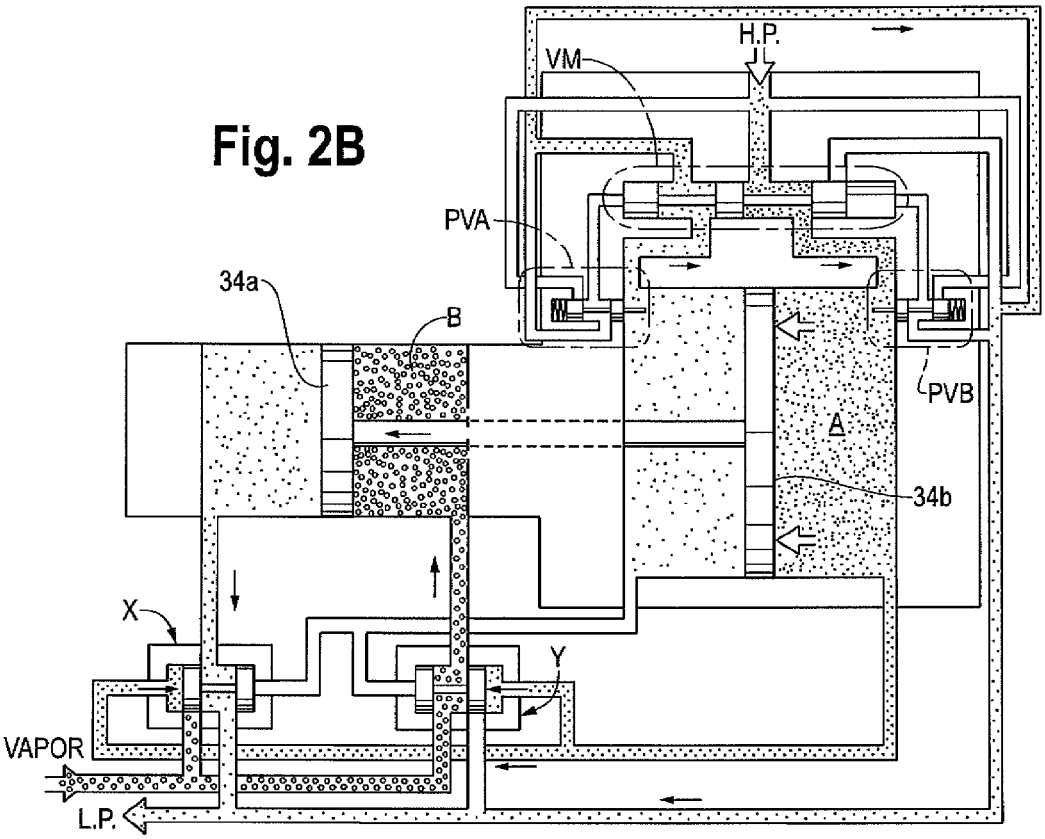

Referring now to FIGS. 2A and 2B, an alternative preferred embodiment of a gas booster system according to the present invention is disclosed. With this embodiment, all check valves and low pressure line connections to the boost cylinder have been eliminated. In their place, two 3-way valves "X" and "Y" are provided. One side of these valves connects a boost cylinder chamber to the vapor line, and the other side connects the boost cylinder chamber to the LP (second, lower gas pressure) line. Both valves are controlled by pilot signals from the HP line and the LP line. In FIG. 2A, the pistons are moving to the right, the gas in chamber B is at LP pressure, and the other side of the boost cylinder is pulling in vapor. At the end of this stroke, the 4-way drive valve VM shifts (for the same reason as described in reference to the embodiment shown in FIGS. 1A-1D), causing the HP drive gas to vent to the LP line and fresh HP gas to fill drive cylinder chamber A. The HP pressure from drive chamber A acting on the 3-way valve pilots causes them to shift (the pilot pressure on the other side of the 3-way valves has been reduced to LP pressure). The B side of the boost chamber will suck in vapor and the other side will be connected to LP pressure through its 3-way valve and instantly fill with LP gas which will mix with the recovered vapor. The cycle continues in this manner.

The approach shown in FIGS. 2A-2B may be preferred due to enhanced volumetric efficiency of the boost cylinder and consequent difficulties in valve design concerning the embodiment shown in FIGS. 1A-1D. The inventor recognizes, however, that there may be applications where the embodiment shown in FIGS. 1A-1D is preferable.

Based on the disclosures and principles taught here, those of ordinary skill in the art will recognize that other valve arrangements which are not shown here will be apparent, and will have the same or similar gas recovery and LP gas pressure equalization results. As one non-limiting example, a gas booster design could be provided employing vapor inlet check valves, and pilot-controlled discharge check valves, which may possibly be preferable in future applications.

Those of ordinary skill in the art will appreciate that, in certain applications, it may be desirable to drive movement of the 4-way valve using mechanically-actuated means.

Those of ordinary skill in the art will further appreciate that gas can only be boosted so many ratios due to temperature increase and volumetric efficiency issues. The present invention eliminates the need for boosting a gas multiple ratios by equalizing the pressure of the fugitive emission vapor and the low pressure gas sink at the end of the suction stroke, as disclosed above.

It will be understood that various modifications to the preferred embodiment disclosed above may be made. The above description is not intended to limit the meaning of the words used in the following claims that define the invention. Rather, it is contemplated that future modifications in structure, function or result will exist that are not substantial changes and that all such insubstantial changes are intended to be covered by the following claims.

I claim:

1. A gas pressure booster, comprising: a drive cylinder and a boost cylinder interconnected by reciprocating drive and boost pistons, the drive piston supplying force powered by a first gas stream at a higher pressure within the drive cylinder which exhausts to a second gas stream at a lower pressure;

wherein fugitive gas emissions originating from one or more of sources including oil and gas wells, natural gas pipeline compressor stations or turbine compressor applications in oil refineries or chemical plants are captured in the boost cylinder and transported to the lower pressure second gas stream to eliminate gas discharged to atmosphere, and having two communicating three-way-valves, wherein one side of the valves connects the boost cylinder to an intake vapor line containing the fugitive gas emissions, and the other side of the valves connects the boost cylinder to a low pressure discharge gas line, the three-way-valves allowing gas pressures in the boost cylinder and the drive cylinder to equalize.

2. The gas pressure booster of claim 1, further comprising a four-way valve actuating the reciprocating piston, the four-way valve operating on differential gas pressure.

3. The gas pressure booster of claim 2, wherein the four-way valve is actuated by gas pilot pressure applied on each side of the valve.

4. The gas pressure booster of claim 2, wherein the four-way valve is actuated by gas pilot pressure applied on one side of the valve.

5. The gas pressure booster of claim 4, wherein venting of the pilot pressure results in a spring actuating a side opposing the one side of the valve.

6. The gas pressure booster of claim 2, wherein the four-way valve is actuated by gas pilot pressure applied to a first valve piston on one side of the valve.

7. The gas pressure booster of claim 6, wherein venting of the pilot pressure results in supply pressure actuating the valve by acting on a second valve piston on a side opposing the one side of the valve, wherein the second valve piston is smaller than the first valve piston.

8. The gas pressure booster of claim 3, wherein return of the valve is actuated by venting the pilot pressure to a low gas pressure line.

9. The gas pressure booster of claim 4, wherein return of the valve is actuated by venting the pilot pressure to a low gas pressure line.

10. The gas pressure booster of claim 6, wherein return of the valve is actuated by venting the pilot pressure to a low gas pressure line.

11. The gas pressure booster of claim 1, wherein the gas pressure booster operates without the need for electricity or cooler water.

12. The gas pressure booster of claim 1, wherein no check valves or low pressure line connections to the boost cylinder are used.

13. A method for recovering fugitive gas emissions of a gas pressure booster having a drive cylinder, a boost cylinder, and interconnected, reciprocating drive and boost pistons, comprising the steps of:

operating the boost cylinder with drive gas at a first gas pressure and venting the drive gas at a second gas pressure which is lower than the first gas pressure;

charging the boost cylinder with fugitive gas emissions originating from one or more of sources including oil and gas wells, natural gas pipeline compressor stations or turbine compressor applications in oil refineries or chemical plants, recovered from operation of the gas pressure booster, by completing a piston stroke of the boost cylinder;

raising the pressure of the recovered fugitive gas emissions by shutting off the source of boost cylinder drive gas at the first higher gas pressure, creating trapped drive gas;

allowing the trapped drive gas at the first higher gas pressure to flow to the charged boost cylinder, so that the gas pressures in the boost cylinder and the drive cylinder equalize at a pressure higher than the fugitive emission gas pressure;

wherein the resulting, equalized pressure in the boost cylinder eliminates the need to stage gas compression as would otherwise be required given the boost compression ratio between the fugitive emission gas pressure and the second lower gas pressure.

14. The method of claim 13, further comprising the step of reversing the piston stroke of the boost cylinder and discharging the mixture of fugitive gas emissions and pressure-reduced drive gas to a line containing the second lower pressure gas.

15. The method of claim 13, wherein the gas pressures in the boost cylinder and the drive cylinder equalize at a pressure that is equal to a sink pressure for the gas pressure booster.

16. The method of claim 13, wherein the boost cylinder operates as recited in claim 13 without the need for electricity or cooling water.

17. The method of claim 13, further comprising two communicating three-way valves, wherein one side of the valves connects the boost cylinder to a vapor line, and the other side of the valves connects the boost cylinder to a low pressure gas line.

18. The method of claim 17, wherein no check valves or low pressure line connections to the boost cylinder are used.

19. The method of claim 13, wherein the gas pressure booster is employed to recover fugitive gas emissions from an oil or gas well.

20. The method of claim 13, wherein the gas pressure booster is employed to recover fugitive gas emissions from a natural gas pipeline compressor station.

21. The method of claim 13, wherein the gas pressure booster is employed to recover fugitive gas emissions from an industrial gas compressor.

* * * * *